US010953310B2

(12) United States Patent
Shen

(10) Patent No.: US 10,953,310 B2
(45) Date of Patent: Mar. 23, 2021

(54) METHOD FOR MANUFACTURING SKATEBOARD

(71) Applicant: Aifu Shen, Zhejiang (CN)

(72) Inventor: Aifu Shen, Zhejiang (CN)

( * ) Notice: Subject to any disclaimer, the term of this patent is extended or adjusted under 35 U.S.C. 154(b) by 0 days.

(21) Appl. No.: 16/449,456

(22) Filed: Jun. 24, 2019

(65) Prior Publication Data

US 2019/0308088 A1 Oct. 10, 2019

(30) Foreign Application Priority Data

Feb. 24, 2019 (CN) ..... 201910134853.7

(51) Int. Cl.
*A63C 17/01* (2006.01)
*B27N 3/08* (2006.01)

(52) U.S. Cl.
CPC ..... *A63C 17/017* (2013.01); *B27N 3/08* (2013.01); *A63C 2203/42* (2013.01)

(58) Field of Classification Search
CPC ..... A63C 17/017; A63C 2203/42; B27N 3/08
See application file for complete search history.

(56) References Cited

U.S. PATENT DOCUMENTS 7,138,027 B1 * 11/2006 Canizales ..... B29C 43/203 156/245
10,137,357 B1 * 11/2018 Rosolowski ..... B32B 3/08
2008/0146101 A1 * 6/2008 Yeh ..... B63B 32/57 441/65
2012/0190473 A1 * 7/2012 Swist ..... A63B 59/20 473/282
2012/0196079 A1 * 8/2012 Brauers ..... B32B 3/26 428/116
2013/0164507 A1 * 6/2013 Shen ..... B32B 27/12 428/196
2014/0110914 A1 * 4/2014 Barrett ..... A63C 17/01 280/87.042
2016/0193793 A1 * 7/2016 Filippini ..... A63B 60/00 428/71
2017/0007909 A1 * 1/2017 MacKay ..... A63C 17/017
2017/0259160 A1 * 9/2017 Docter ..... A63C 5/052
2018/0333633 A1 * 11/2018 Kelly ..... A63C 17/017
2018/0345121 A1 * 12/2018 Goehring, Jr. ..... B32B 27/08
2019/0118515 A1 * 4/2019 Constantinou ..... A43B 5/02

* cited by examiner

*Primary Examiner* — Brian L Swenson

(57) ABSTRACT

A method for manufacturing a skateboard, includes steps of: foaming an organic polymer material with steam with a temperature at a range of 160-180° C. to produce a foam board as the internal core board; sending the organic polymer material into an oven for heating to 190-210° C. to perform foam molding; cutting the foam board into an internal core layer; cutting the foam board into an upper surface layer and a lower surface layer; and then adhering the upper surface layer and the lower surface layer with the internal core layer together by EVA resin, and wrapping the internal core layer between the upper surface layer and the lower surface layer; printing a pattern layer on a surface of the plate body by laser printing; and casting a layer of the plastic film.

10 Claims, 8 Drawing Sheets

METHOD FOR MANUFACTURING SKATEBOARD

CROSS REFERENCE OF RELATED APPLICATION

The present application claims priority under 35 U.S.C. 119(a-d) to CN 201910134853.7, filed Feb. 24, 2019.

BACKGROUND OF THE PRESENT INVENTION

Field of Invention

The present invention relates to the technical field of skateboard manufacturing, and more particularly to a method for manufacturing skateboard.

Description of Related Arts

A Chinese patent with an application number of CN201110460726.X and a title of Method for manufacturing skateboard discloses a method for manufacturing a skateboard, wherein the manufacturing method is characterized in comprising following steps of: (1) foaming; (2) cooling the foaming mold with water, taking out the foamed board to be naturally cooled to a room temperature and drying; (3) wrapping with glass fiber cloth, and then spraying or coating with epoxy resin; (4) solidifying and polishing; (5) wrapping with glass fiber cloth, and then spraying or coating with epoxy resin again; (6) spreading plastic sheet with the patterns printed thereon, so that the corresponding peripheral edges of upper and lower plastic sheets are directly connected together; (7) pressing and forming; (8) trimming and grinding. The advantages of the present invention lie in that in the manufacturing method, the corresponding peripheral edges of the upper and lower plastic sheets of the moving skateboard are directly combined, so that the upper and lower plastic sheets are integrally formed into one body, and the internal core is wrapped together, in such a manner that the structure of the skateboard is firmer, the service life is longer and the peripheral edges are smoother, so the resistance of the water to the skateboard is reduced when the skateboard slides, which makes the skateboard easier to handle. However, the pattern produced by the manufacturing method is not printed by laser, so the color, sharpness and vividness of the pattern are not satisfying, and therefore the manufacturing method of the skateboard needs further improvement.

SUMMARY OF THE PRESENT INVENTION

In view of the technical problems in the conventional art mentioned above, an object of the present invention is to provide a method for manufacturing a skateboard with a light weight, a low manufacturing cost, a bright pattern which is difficult to fade and wear.

In order to solve the technical problems mentioned above, a technical solution adopted by the present invention is as follows. A method for manufacturing a skateboard, comprising steps of:

step (1) manufacturing an internal core board, comprising: foaming an organic polymer material with steam with a temperature at a range of 160-180° C. to produce a foam board as the internal core board;

step (2) manufacturing an upper surface board and a lower surface board, comprising: sending the organic polymer material into an oven for heating to 190-210° C. to perform foam molding for serving as a foam sheet material of an upper surface board and a lower surface board;

step (3) cutting and molding, comprising: cutting the foam board in the step (1) into an internal core layer 1 which is preset according to requirements step (4) manufacturing a plate body, comprising: placing the internal core layer between the upper surface layer and the lower surface layer, and then adhering the upper surface layer and the lower surface layer with the internal core layer together by EVA resin, and wrapping the internal core layer between the upper surface layer and the lower surface layer to form a board according to requirement of a skateboard;

step (5) manufacturing a pattern layer on a surface of the plate body, comprising: printing a pattern layer on a surface of the plate body by laser printing; and step (6) manufacturing a plastic film, and a layer of plastic film is cast on the pattern layer on the bottom surface of the plate body, casting a layer of the plastic film on the pattern layer provided on a bottom layer of the plate body, in such a manner that the method for manufacturing the skateboard is completed;

wherein a process of the laser printing comprises steps of:

step (a) performing primer treatment on a PET film with an acrylic resin, and performing laser embossing on the PET film treated, and then vacuum-aluminizing the PET film to obtain a composite PET film desired;

step (b) covering a composite PET film with polyurethane printing ink by gravure to form an ink layer, and painting a surface of the ink layer printed with an acrylic resin by a brush to form a protective film layer;

step (c) brushing polyurethane glue on a surface of the PE film which is transparent, after drying in an oven, covering a glue surface of the PE film on an ink surface of the composite PET film, and then pressing by a press roll, wherein a pressing pressure is at a range of 0.8-1.2 MPa, a temperature of a pressure roller is at a range of 60-80° C.; after the pressing, the PET film is peeled off the PE film to transfer an ink and laser effect to the PE film which is transparent;

step (d) brushing a layer of polyurethane glue on an external surface of the plate body, then drying the plate body at a set temperature, and then covering the ink pattern layer of the PE film which is transparent to a surface of the plate body dried;

step (e) transferring the plate body covered with the PE film to a curing chamber at a constant temperature of 40° C. for aging, and taking out after an aging time of 46-50 hours to obtain a laser-printed pattern.

Preferably, the organic polymer material adopted in the step (1) is a plastic made of EPS, EPP or EPO.

Preferably, the organic polymer material adopted in the step (2) is a plastic made of LDPE.

Preferably, the plastic film in the step (5) is made of HDPE plastic.

Preferably, in the laser printing, the step (a) adopts a PET film with a thickness of 0.015 mm.

Preferably, in the laser printing, the drying the step (d) is performed in the oven, and a temperature set is at a range of 70-80° C.

Preferably, a layer of cushioning plastic is adhered and fixed to a bottom chamfer of a side wall of the skateboard which is finished.

In order to solve the technical problems mentioned above, another technical solution adopted by the present invention is: a method for manufacturing a skateboard, specifically comprising steps of:

step (1) manufacturing an internal core board, comprising: foaming an organic polymer material with steam with a temperature at a range of 160-180° C. to produce a foam board as the internal core board;

step (2) manufacturing an upper surface board and a lower surface board, comprising: sending the organic polymer material into an oven for heating to 190-210° C. to perform foam molding for serving as a foam step (3) cutting and molding, comprising: cutting the foam board in the step (1) into an internal core layer 1 which is preset according to requirements step (4) manufacturing a plate body, comprising: placing the internal core layer between the upper surface layer and the lower surface layer, and then adhering the upper surface layer and the lower surface layer with the internal core layer together by EVA resin, and wrapping the internal core layer between the upper surface layer and the lower surface layer to form a board according to requirement of a skateboard;

step (5) manufacturing a pattern layer on a surface of the plate body, comprising: printing a pattern layer on a surface of the plate body by laser printing; and step (6) manufacturing a plastic film, and a layer of plastic film is cast on the pattern layer on the bottom surface of the plate body, casting a layer of the plastic film on the pattern layer provided on a bottom layer of the plate body, in such a manner that the method for manufacturing the skateboard is completed;

wherein a process of the laser printing comprises steps of:

step (a) performing primer treatment on a PET film with an acrylic resin, and performing laser embossing on the PET film treated, and then vacuum-aluminizing the PET film to obtain a composite PET film desired;

step (b) covering a composite PET film with polyurethane printing ink by gravure to form an ink layer, and painting a surface of the ink layer printed with an acrylic resin by a brush to form a protective film layer;

step (c) brushing polyurethane glue on a surface of the PE film which is transparent, after drying in an oven, covering a glue surface of the PE film on an ink surface of the composite PET film, and then pressing by a press roll, wherein a pressing pressure is at a range of 0.8-1.2 MPa, a temperature of a pressure roller is at a range of 60-80° C.; after the pressing, the PET film is peeled off the PE film to transfer an ink and laser effect to the PE film which is transparent;

step (d) brushing a layer of polyurethane glue on an external surface of a porcelain white PE film, then sending porcelain white PE film with the layer of polyurethane glue brushed into the oven for drying, and then covering and adhering a glue surface of the porcelain white PE film dried on an the ink surface of the PE film which is transparent;

step (e) transferring the PE film adhered to a curing chamber at a constant temperature of 40° C. for aging, and taking out after an aging time of 46-50 hours to obtain a laser PE film;

step (f) coating and adhering a porcelain white PE film surface of the laser PE film on an external surface of the plate body by glue coating, thereby obtaining a laser printing pattern.

Preferably, the organic polymer material adopted in the step (1) is a plastic made of EPS, EPP or EPO; the organic polymer material adopted in the step (2) is a plastic made of LDPE; the plastic film in the step (5) is made of HDPE plastic. In the laser printing, the step (a) adopts a PET film with a thickness of 0.015 mm; in the laser printing, the drying the step (d) is performed in the oven, and a temperature set is at a range of 70-80° C.; a layer of cushioning plastic is adhered and fixed to a bottom chamfer of a side wall of the skateboard which is finished.

Compared with the conventional art, the invention has the advantages as follows. A main structure of the skateboard is prepared by using the internal core layer, foam boards on the upper surface layer and the lower surface layer, which is not only light in weight, convenient to carry, but also firmly bonded and difficult to separate. When adopted in a surfboard, because waterproof property of materials of the internal core layer, the upper surface layer and the lower surface layer itself are all good, the production cost is low, and the service life is long. The present invention has a further advantage in that: the pattern of the present invention is made by the laser printing method, so the pattern is not only bright and clear, but also the pattern is not easy to fade and wear. That is because there is a layer of laser PE protective film on the surface of the pattern. The method is firstly invented by the applicant of the present invention. The method of manufacturing the skateboards effectively eliminates the defects that the surface of the pattern is directly exposed to the surface by laser printing without a protective film, which causes the pattern to fade and wear easily. Therefore, the pattern manufactured by the laser printing method of the present invention has a vivid, clear and realistic effect of always maintaining the pattern; further, on a bottom surface of the skateboard, i.e., a layer of cast plastic film is added to the inside of the layer to further increase toughness and strength of the bottom surface of the skateboard. In summary, the skateboard manufactured by the method of the present invention has the advantages of convenient manufacture and light weight of the skateboard, convenience in carrying, low production cost, and with wide application for skiing, skating, sand skating and surfing; bright, clear and uneasy fading and wearing pattern, and a long service life.

DETAILED DESCRIPTION OF THE PREFERRED EMBODIMENT

Figure 1:
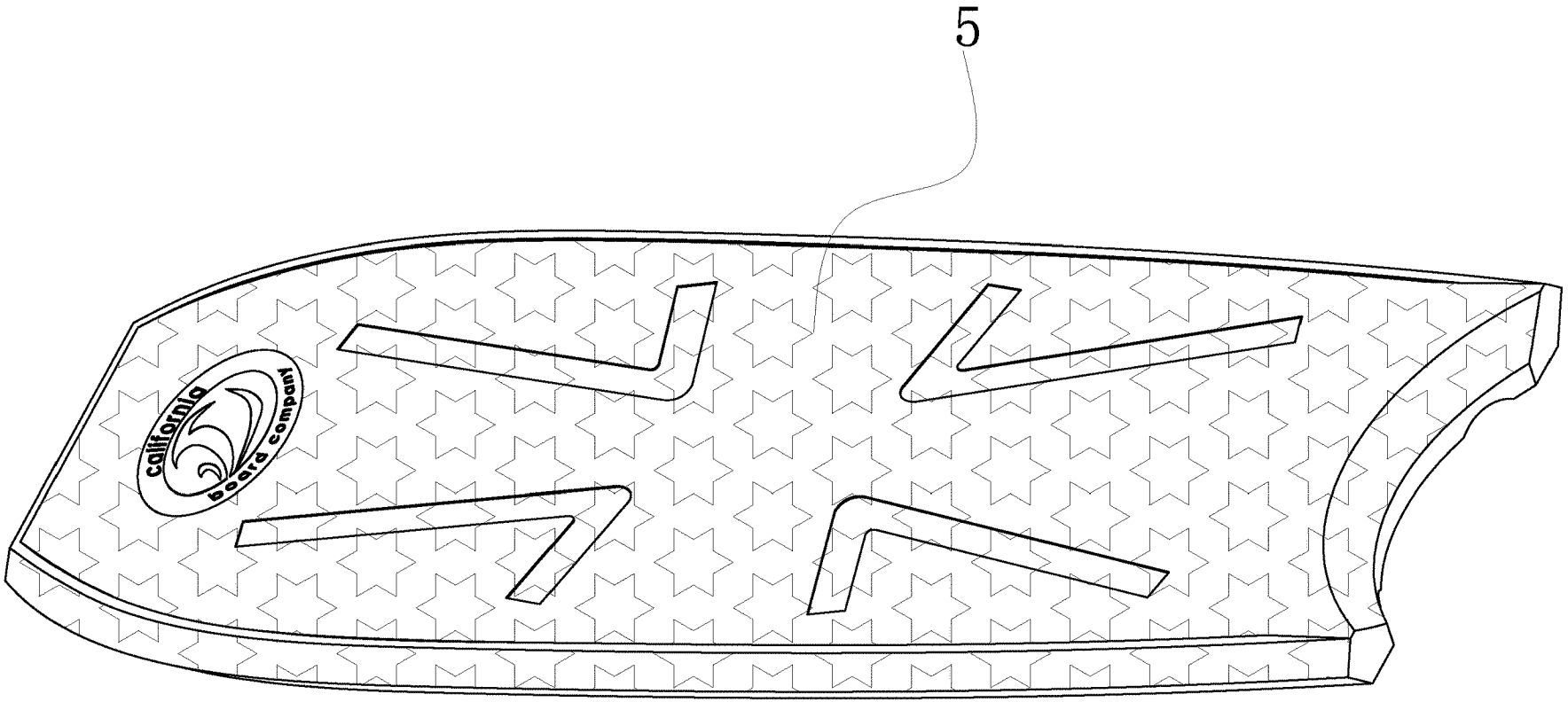
FIG. 1 is a stereogram according to a preferred embodiment of the present invention.
Figure 2:
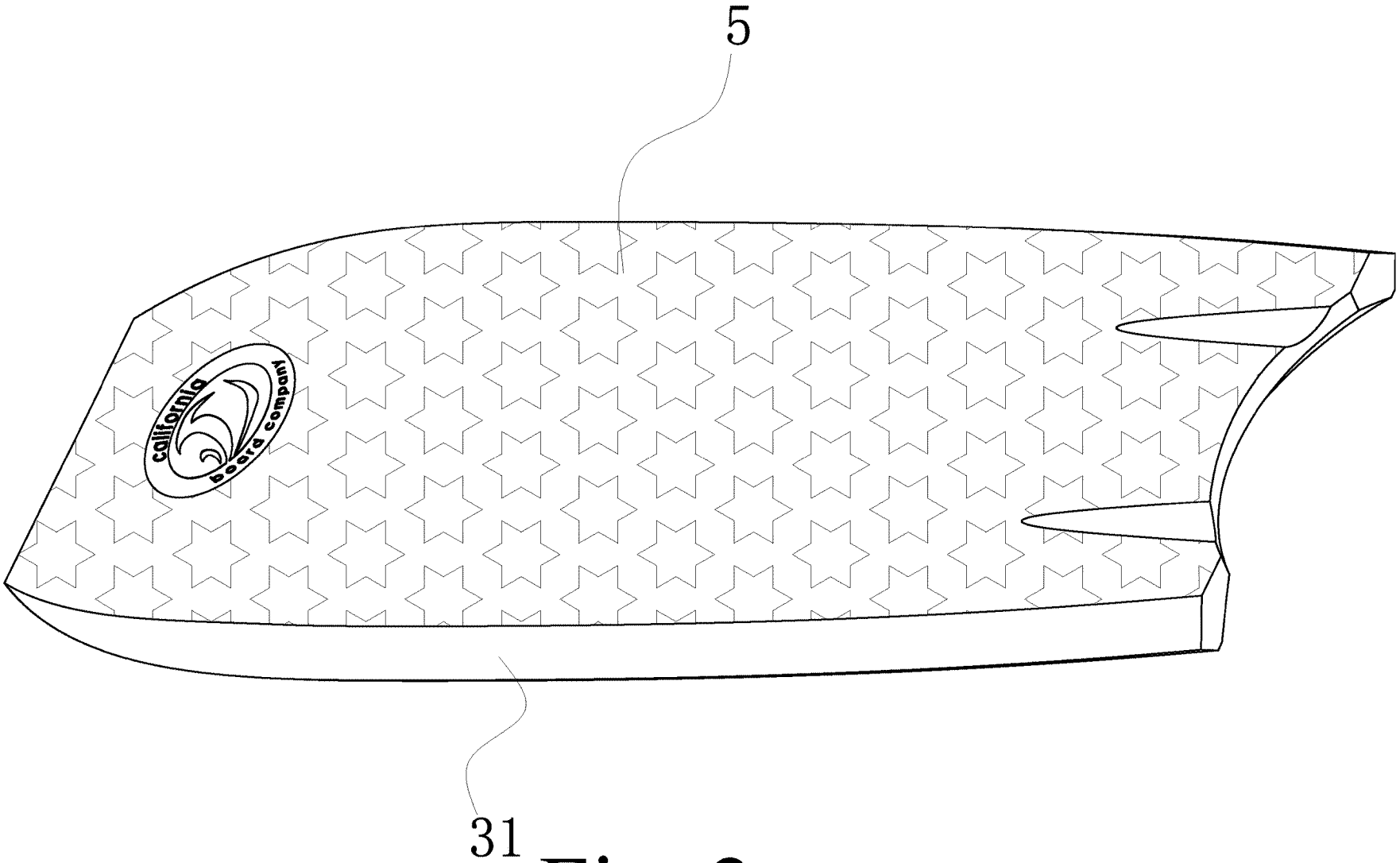
FIG. 2 is a stereogram of the FIG. 1 at another angle.
Figure 3:
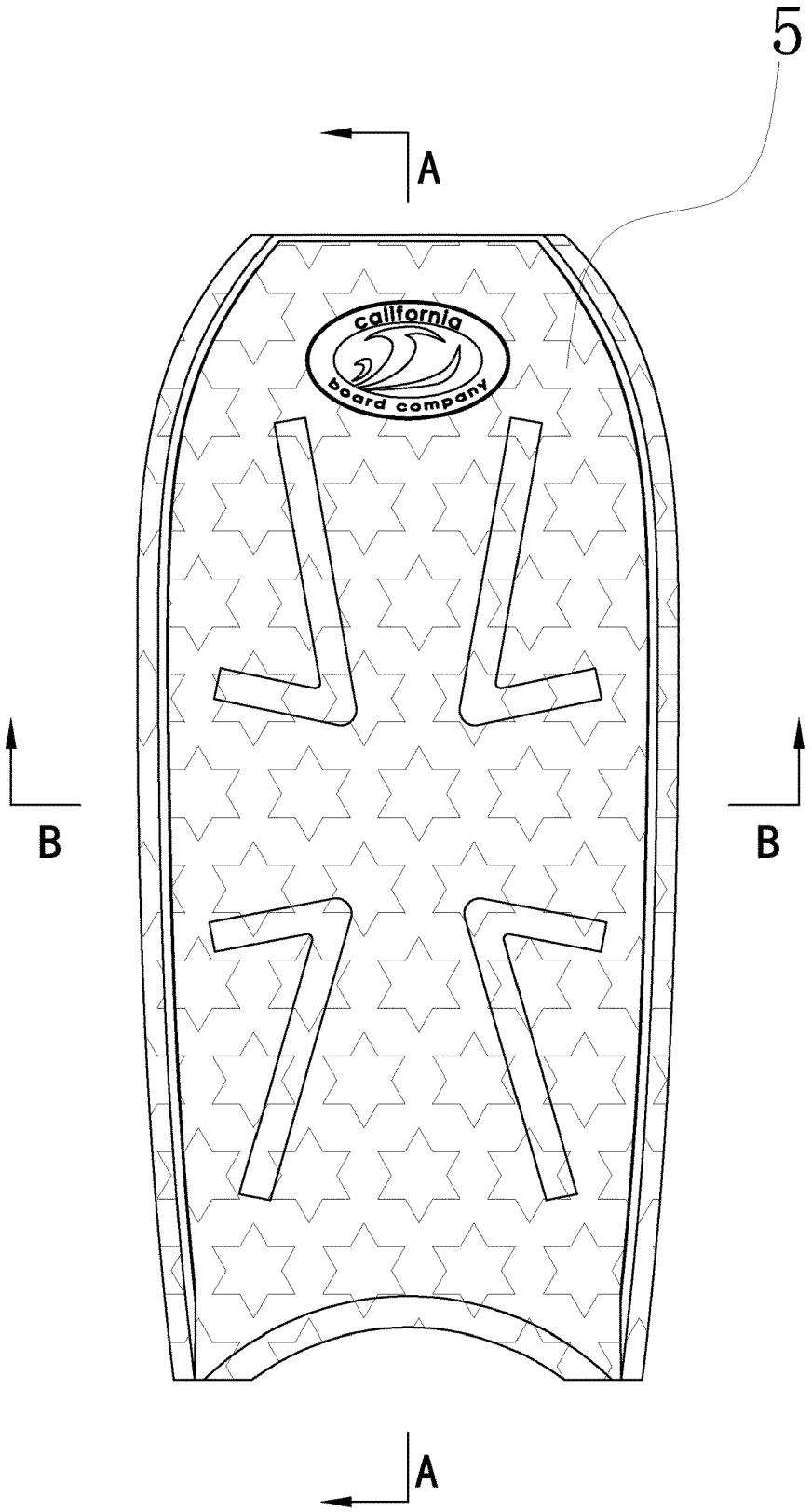
FIG. 3 is a plan view of FIG. 1.
Figure 4:
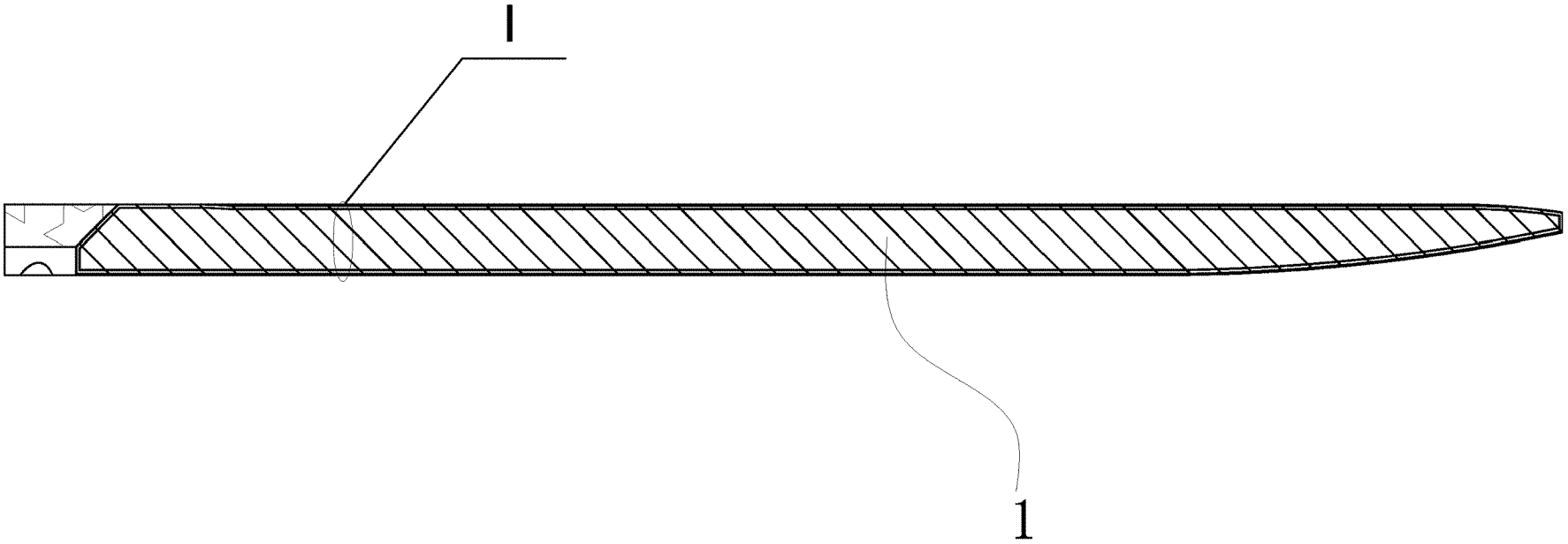
FIG. 4 is a cross-sectional view taken along line A-A of FIG. 3.
Figure 5:
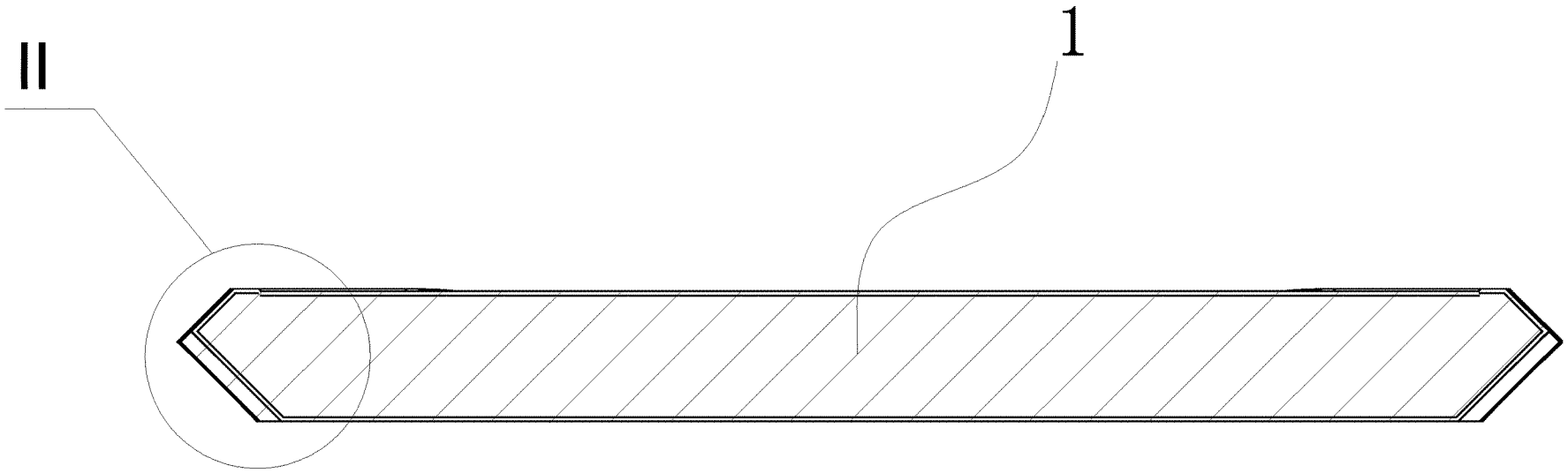
FIG. 5 is a cross-sectional view taken along line B-B of FIG. 3.

Further description of the present invention is illustrated combining with the accompanying drawing and the preferred embodiments of the present invention.

As shown to FIGS. 1-8, according to a preferred embodiment of the present invention, a method for manufacturing skateboard, comprises steps of:

step (1) manufacturing an internal core board, comprising: foaming an organic polymer material with steam with a temperature at a range of 160-180° C. to produce a foam board as the internal core board;

step (2) manufacturing an upper surface board and a lower surface board, comprising: sending the organic polymer material into an oven for heating to 190-210° C. to perform foam molding for serving as a foam sheet material of an upper surface board and a lower surface board;

step (3) cutting and molding, comprising: cutting the foam board in the step (1) into an internal core layer 1 which is preset according to requirements step (4) manufacturing a plate body, comprising: placing the internal core layer 1 between the upper surface layer 2 and the lower surface layer 3, and then adhering the upper surface layer 2 and the lower surface layer 3 with the internal core layer 1 together by EVA resin, and wrapping the internal core layer 1 between the upper surface layer 2 and the lower surface layer 3 to form a board according to requirement of a skateboard;

step (5) manufacturing a pattern layer on a surface of the plate body, comprising: printing a pattern layer 5 on a surface of the plate body by laser printing; and step (6) manufacturing a plastic film, and a layer of plastic film 4 is cast on the pattern layer on the bottom surface of the plate body, casting a layer of the plastic film 4 on the pattern layer provided on a bottom layer of the plate body, in such a manner that the method for manufacturing the skateboard is completed;

wherein a process of the laser printing comprises steps of:

step (a) performing primer treatment on a PET film with an acrylic resin, and performing laser embossing on the PET film treated, and then vacuum-aluminizing the PET film to obtain a composite PET film desired;

step (b) covering a composite PET film with polyurethane printing ink by gravure to form an ink layer, and painting a surface of the ink layer printed with an acrylic resin by a brush to form a protective film layer;

step (c) brushing polyurethane glue on a surface of the PE film which is transparent, after drying in an oven, covering a glue surface of the PE film on an ink surface of the composite PET film, and then pressing by a press roll, wherein a pressing pressure is at a range of 0.8-1.2 MPa, a temperature of a pressure roller is at a range of 60-80° C.; after the pressing, the PET film is peeled off the PE film to transfer an ink and laser effect to the PE film which is transparent;

step (d) brushing a layer of polyurethane glue on an external surface of the plate body, then drying the plate body at a set temperature, and then covering the ink pattern layer of the PE film which is transparent to a surface of the plate body dried;

step (e) transferring the plate body covered with the PE film to a curing chamber at a constant temperature of 40° C. for aging, and taking out after an aging time of 46-50 hours to obtain a laser-printed pattern.

The organic polymer material adopted in the step (1) is a plastic made of EPS, EPP or EPO; the organic polymer material adopted in the step (2) is a plastic made of LDPE; the plastic film in the step (5) is made of HDPE plastic. In the laser printing, the step (a) adopts a PET film with a thickness of 0.015 mm; in the laser printing, the drying the step (d) is performed in the oven, and a temperature set is at a range of 70-80° C.; a layer of cushioning plastic 31 is adhered and fixed to a bottom chamfer of a side wall of the skateboard which is finished. The casting process of the plastic film is a well-known conventional art and will not be described in detail.

Figure 6:
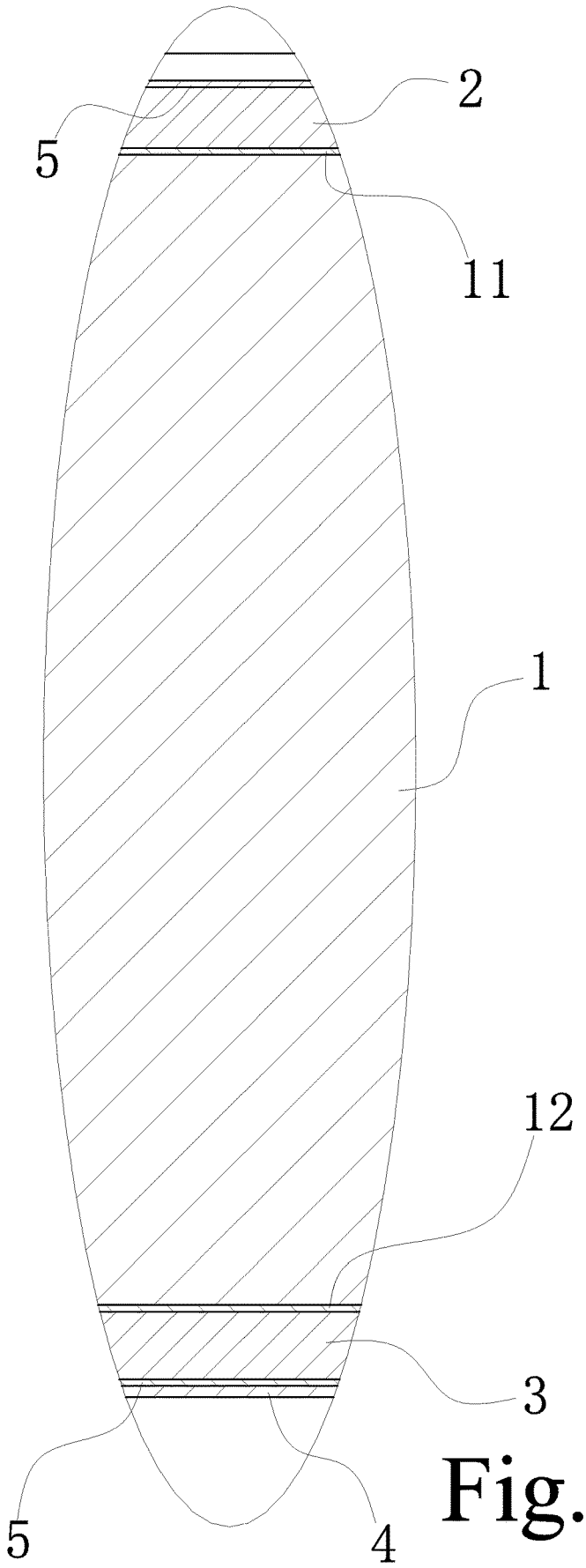
FIG. 6 is an enlarged view of a portion I of FIG. 4.
Figure 7:
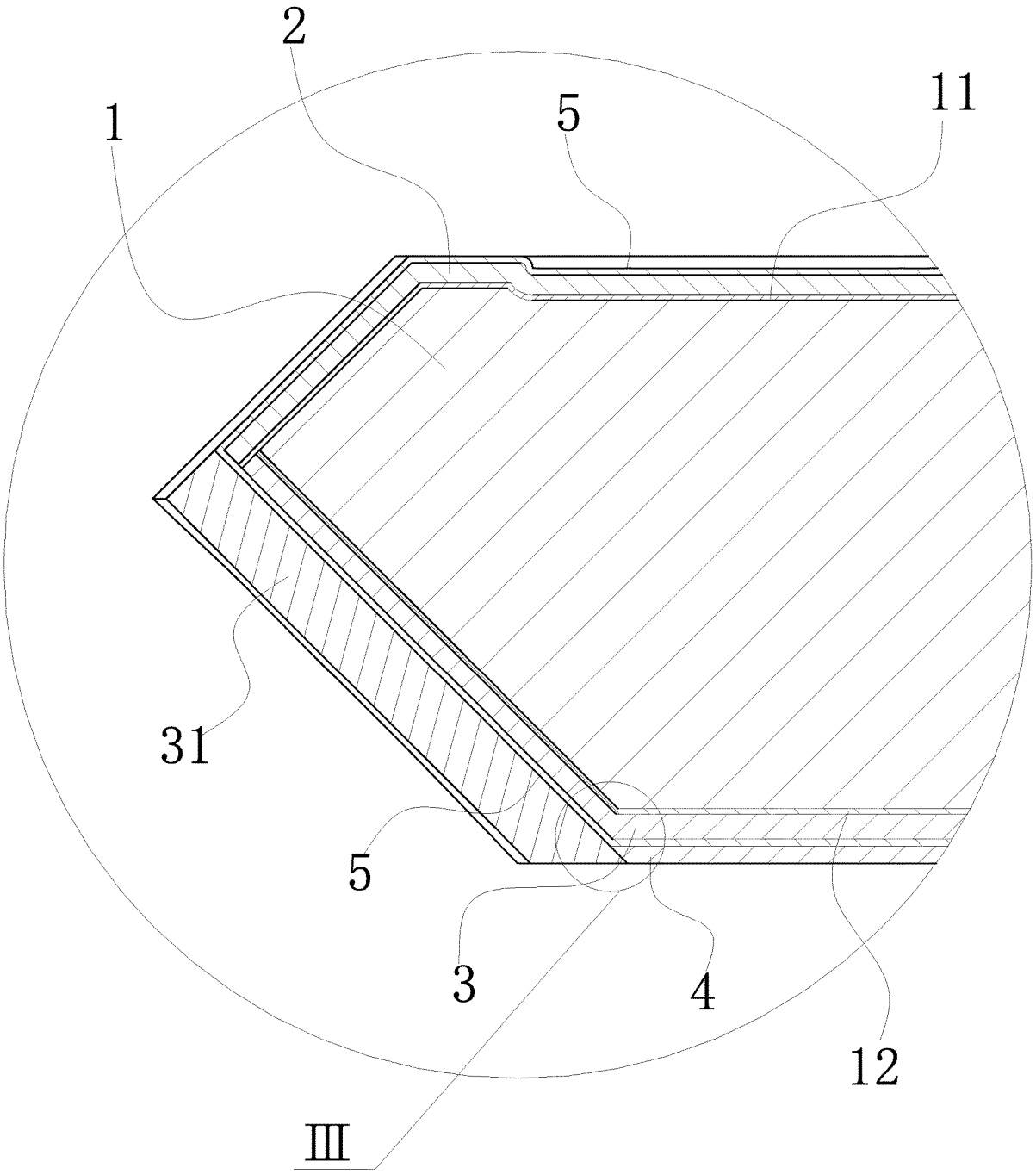
FIG. 7 is an enlarged view of a portion II of FIG. 5.
Figure 8:
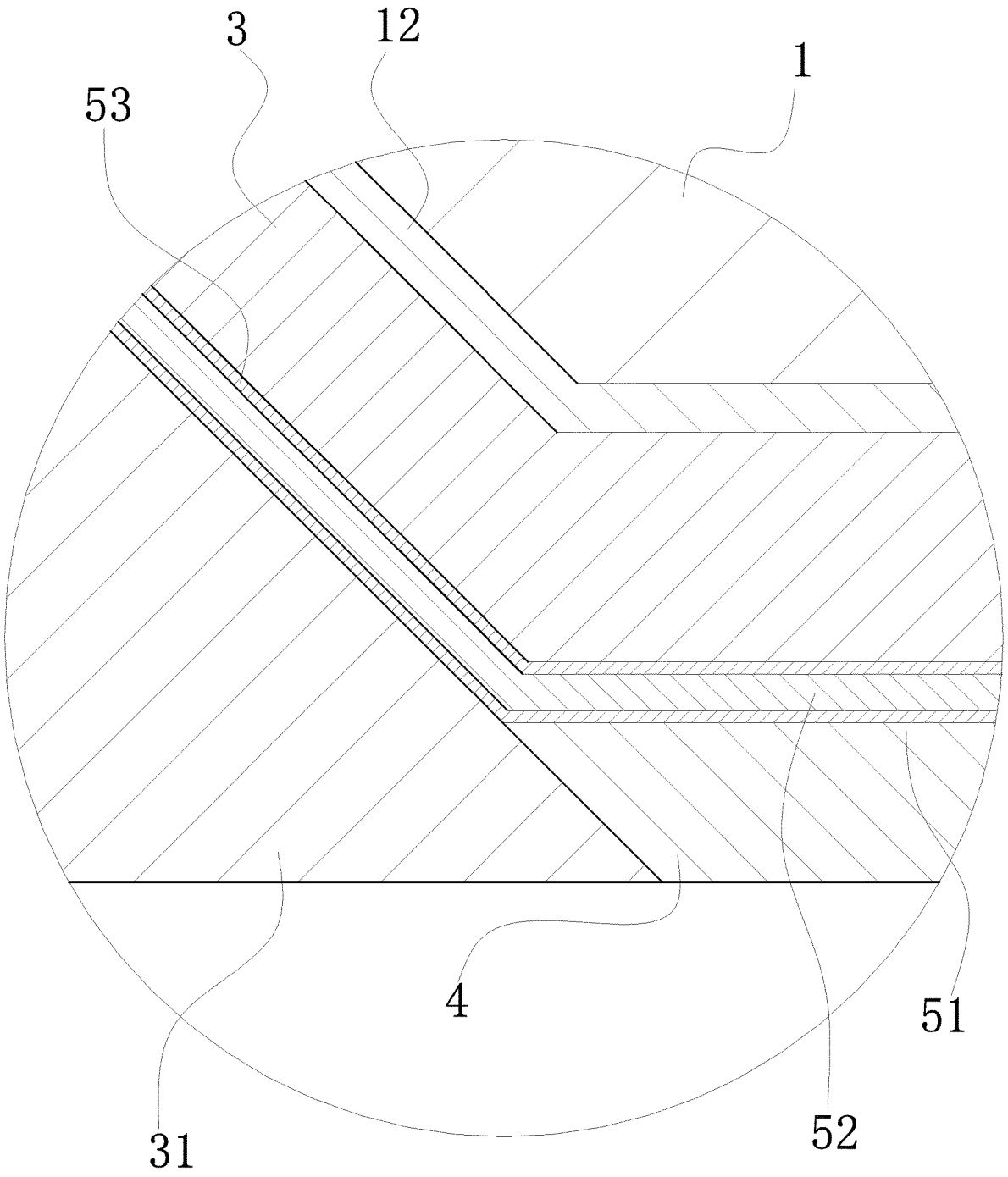
FIG. 8 is an enlarged view of a portion III of FIG. 7.

As shown in FIGS. 6-8, resin glue forms a first glue layer 11 between the internal core board 1 and the upper surface layer 2 which is in a shape of a sheet, and a second glue layer 12 between the internal core board 1 and the lower surface layer 3 which is in a shape of a sheet, and an outermost layer of the pattern layer 5 is a protective layer 51 formed by a transparent PE film, the ink layer 52 is located inside the protective layer 51, and an innermost layer of the pattern layer 5 is a polyurethane glue layer 53.

According to another preferred embodiment of the present invention, a method for manufacturing a skateboard, specifically comprising steps of:

step (1) manufacturing an internal core board, comprising: foaming an organic polymer material with steam with a temperature at a range of 160-180° C. to produce a foam board as the internal core board;

step (2) manufacturing an upper surface board and a lower surface board, comprising: sending the organic polymer material into an oven for heating to 190-210° C. to perform foam molding for serving as a foam step (3) cutting and molding, comprising: cutting the foam board in the step (1) into an internal core layer 1 which is preset according to requirements step (4) manufacturing a plate body, comprising: placing the internal core layer 1 between the upper surface layer 2 and the lower surface layer 3, and then adhering the upper surface layer 2 and the lower surface layer 3 with the internal core layer 1 together by EVA resin, and wrapping the internal core layer 1 between the upper surface layer 2 and the lower surface layer 3 to form a board according to requirement of a skateboard;

step (5) manufacturing a pattern layer on a surface of the plate body, comprising: printing a pattern layer 5 on a surface of the plate body by laser printing; and step (6) manufacturing a plastic film, and a layer of plastic film 4 is cast on the pattern layer on the bottom surface of the plate body, casting a layer of the plastic film 4 on the pattern layer provided on a bottom layer of the plate body, in such a manner that the method for manufacturing the skateboard is completed;

wherein a process of the laser printing comprises steps of:

step (a) performing primer treatment on a PET film with an acrylic resin, and performing laser embossing on the PET film treated, and then vacuum-aluminizing the PET film to obtain a composite PET film desired;

step (b) covering a composite PET film with polyurethane printing ink by gravure to form an ink layer, and painting a surface of the ink layer printed with an acrylic resin by a brush to form a protective film layer;

step (c) brushing polyurethane glue on a surface of the PE film which is transparent, after drying in an oven, covering a glue surface of the PE film on an ink surface of the composite PET film, and then pressing by a press roll, wherein a pressing pressure is at a range of 0.8-1.2 MPa, a temperature of a pressure roller is at a range of 60-80° C.; after the pressing, the PET film is peeled off the PE film to transfer an ink and laser effect to the PE film which is transparent;

step (d) brushing a layer of polyurethane glue on an external surface of a porcelain white PE film, then sending porcelain white PE film with the layer of polyurethane glue brushed into the oven for drying, and then covering and adhering a glue surface of the porcelain white PE film dried on an the ink surface of the PE film which is transparent;

step (e) transferring the PE film adhered to a curing chamber at a constant temperature of 40° C. for aging, and taking out after an aging time of 46-50 hours to obtain a laser PE film;

step (f) coating and adhering a porcelain white PE film surface of the laser PE film on an external surface of the plate body by glue coating, thereby obtaining a laser printing pattern.

The organic polymer material adopted in the step (1) is a plastic made of EPS, EPP or EPO; the organic polymer material adopted in the step (2) is a plastic made of LDPE; the plastic film in the step (5) is made of HDPE plastic. In the laser printing, the step (a) adopts a PET film with a thickness of 0.015 mm; in the laser printing, the drying the step (d) is performed in the oven, and a temperature set is at a range of 70-80° C.; a layer of cushioning plastic 31 is adhered and fixed to a bottom chamfer of a side wall of the skateboard which is finished. The EVA resin glue is a well-known glue which is available on the Internet.

What is claimed is:

1. A method for manufacturing a skateboard, comprising steps of:

step (1) manufacturing an internal core board, comprising: foaming an organic polymer material with steam with a temperature at a range of 160-180° C. to produce a foam board as the internal core board;

step (2) manufacturing an upper surface board and a lower surface board, comprising: sending the organic polymer material into an oven for heating to 190-210° C. to perform foam molding for serving as a foam sheet material of an upper surface board and a lower surface board;

step (3) cutting and molding, comprising: cutting the foam board in the step (1) into an internal core layer 1 which is preset in step 4;

step (4) manufacturing a plate body, comprising: placing the internal core layer (1) between the upper surface layer (2) and the lower surface layer (3), and then adhering the upper surface layer (2) and the lower surface layer (3) with the internal core layer (1) together by EVA resin, and wrapping the internal core layer (1) between the upper surface layer (2) and the lower surface layer (3) to form a board according to requirement of a skateboard;

step (5) manufacturing a pattern layer on a surface of the plate body, comprising: printing a pattern layer (5) on a surface of the plate body by laser printing; and step (6) manufacturing a plastic film, and a layer of plastic film (4) is cast on the pattern layer on the bottom surface of the plate body, casting a layer of the plastic film (4) on the pattern layer provided on a bottom layer of the plate body, in such a manner that the method for manufacturing the skateboard is completed;

wherein a process of the laser printing comprises steps of:

step (a) performing primer treatment on a PET film with an acrylic resin, and performing laser embossing on the PET film treated, and then vacuum-aluminizing the PET film to obtain a composite PET film desired;

step (b) covering a composite PET film with polyurethane printing ink by gravure to form an ink layer, and painting a surface of the ink layer printed with an acrylic resin by a brush to form a protective film layer;

step (c) brushing polyurethane glue on a surface of the PE film which is transparent, after drying in an oven, covering a glue surface of the PE film on an ink surface of the composite PET film, and then pressing by a press roll, wherein a pressing pressure is at a range of 0.8-1.2 MPa, a temperature of a pressure roller is at a range of 60-80° C.; after the pressing, the PET film is peeled off the PE film to transfer an ink and laser effect to the PE film which is transparent;

step (d) brushing a layer of polyurethane glue on an external surface of the plate body, then drying the plate body at a set temperature, and then covering the ink pattern layer of the PE film which is transparent to a surface of the plate body dried;

step (e) transferring the plate body covered with the PE film to a curing chamber at a constant temperature of 40° C. for aging, and taking out after an aging time of 46-50 hours to obtain a laser-printed pattern.

2. The method for manufacturing the skateboard, as recited in claim 1, wherein the organic polymer material adopted in the step (1) is a plastic made of EPS, EPP or EPO.

3. The method for manufacturing the skateboard, as recited in claim 1, wherein the organic polymer material adopted in the step (2) is a plastic made of LDPE.

4. The method for manufacturing the skateboard, as recited in claim 1, wherein the plastic film in the step (5) is made of HDPE plastic.

5. The method for manufacturing the skateboard, as recited in claim 1, wherein in the laser printing, the step (a) adopts a PET film with a thickness of 0.015 mm.

6. The method for manufacturing the skateboard, as recited in claim 1, wherein in the laser printing, the drying the step (d) is performed in the oven, and a temperature set is at a range of 70-80° C.

7. The method for manufacturing the skateboard, as recited in claim 1, a layer of cushioning plastic (31) is adhered and fixed to a bottom chamfer of a side wall of the skateboard which is finished.

8. A method for manufacturing a skateboard, specifically comprising steps of:

step (1) manufacturing an internal core board, comprising: foaming an organic polymer material with steam with a temperature at a range of 160-180° C. to produce a foam board as the internal core board;

step (2) manufacturing an upper surface board and a lower surface board, comprising: sending the organic polymer material into an oven for heating to 190-210° C. to perform foam molding for serving as a foam step (3) cutting and molding, comprising: cutting the foam board in the step (1) into an internal core layer 1 which is preset in step 4;

step (4) manufacturing a plate body, comprising: placing the internal core layer (1) between the upper surface layer (2) and the lower surface layer (3), and then adhering the upper surface layer (2) and the lower surface layer (3) with the internal core layer (1) together by EVA resin, and wrapping the internal core layer (1) between the upper surface layer (2) and the lower surface layer (3) to form a board according to requirement of a skateboard;

step (5) manufacturing a pattern layer on a surface of the plate body, comprising: printing a pattern layer (5) on a surface of the plate body by laser printing; and step (6) manufacturing a plastic film, and a layer of plastic film (4) is cast on the pattern layer on the bottom surface of the plate body, casting a layer of the plastic film (4) on the pattern layer provided on a bottom layer of the plate body, in such a manner that the method for manufacturing the skateboard is completed;

wherein a process of the laser printing comprises steps of:

step (a) performing primer treatment on a PET film with an acrylic resin, and performing laser embossing on the PET film treated, and then vacuum-aluminizing the PET film to obtain a composite PET film desired;

step (b) covering a composite PET film with polyurethane printing ink by gravure to form an ink layer, and painting a surface of the ink layer printed with an acrylic resin by a brush to form a protective film layer;

step (c) brushing polyurethane glue on a surface of the PE film which is transparent, after drying in an oven, covering a glue surface of the PE film on an ink surface of the composite PET film, and then pressing by a press roll, wherein a pressing pressure is at a range of 0.8-1.2 MPa, a temperature of a pressure roller is at a range of 60-80° C.; after the pressing, the PET film is peeled off the PE film to transfer an ink and laser effect to the PE film which is transparent;

step (d) brushing a layer of polyurethane glue on an external surface of a porcelain white PE film, then sending porcelain white PE film with the layer of polyurethane glue brushed into the oven for drying, and then covering and adhering a glue surface of the porcelain white PE film dried on an the ink surface of the PE film which is transparent;

step (e) transferring the PE film adhered to a curing chamber at a constant temperature of 40° C. for aging, and taking out after an aging time of 46-50 hours to obtain a laser PE film;

step (f) coating and adhering a porcelain white PE film surface of the laser PE film on an external surface of the plate body by glue coating, thereby obtaining a laser printing pattern.

9. The method for manufacturing a skateboard, as recited in claim 8, wherein the organic polymer material adopted in the step (1) is a plastic made of EPS, EPP or EPO; the organic polymer material adopted in the step (2) is a plastic made of LDPE; the plastic film in the step (5) is made of HDPE plastic.

10. The method for manufacturing a skateboard, as recited in claim 8, wherein in the laser printing, the step (a) adopts a PET film with a thickness of 0.015 mm; in the laser printing, the drying the step (d) is performed in the oven, and a temperature set is at a range of 70-80° C.; a layer of cushioning plastic (31) is adhered and fixed to a bottom chamfer of a side wall of the skateboard which is finished.

* * * * *